US007470001B2

(12) United States Patent
Kim et al.

(10) Patent No.: US 7,470,001 B2
(45) Date of Patent: Dec. 30, 2008

(54) THERMAL INKJET PRINTHEAD APPARATUS TO REGULATE PRESSURE EXERTED BY BUBBLES IN AN INK CHAMBER AND METHOD THEREOF

(75) Inventors: Kyong-il Kim, Seoul (KR); Su-ho Shin, Seongnam-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 400 days.

(21) Appl. No.: 11/311,652

(22) Filed: Dec. 20, 2005

(65) Prior Publication Data

US 2006/0284934 A1 Dec. 21, 2006

(30) Foreign Application Priority Data

Jun. 16, 2005 (KR) ..... 10-2005-0052034

(51) Int. Cl.
*B41J 2/05* (2006.01)

(52) U.S. Cl. ..... 347/56; 347/62; 347/63; 347/67

(58) Field of Classification Search ..... 347/20, 347/48, 56, 61–65, 67, 44, 47, 57–59
See application file for complete search history.

(56) References Cited

U.S. PATENT DOCUMENTS

| | | | | |
|---|---|---|---|---|
| 4,794,410 | A | 12/1988 | Taub et al. | 347/65 |
| 4,914,562 | A * | 4/1990 | Abe et al. | 347/63 |
| 7,168,787 | B2 * | 1/2007 | Jung et al. | 347/47 |

FOREIGN PATENT DOCUMENTS

| | | |
|---|---|---|
| JP | 59-95155 | 6/1984 |
| JP | 63-189244 | 8/1988 |
| KR | 2001-45305 | 6/2001 |

OTHER PUBLICATIONS

Chinese Office Action dated May 30, 2008 issued in CN 2006-10067606.2.

* cited by examiner

*Primary Examiner*—Juanita D Stephens
(74) *Attorney, Agent, or Firm*—Stanzione & Kim, LLP

(57) ABSTRACT

A thermal inkjet printhead. The inkjet printhead includes a heater that heats an ink in an ink chamber to generate a bubble, conductors to supply an electric current to the heater, and a bubble separation wall protuberantly formed on the heater to protect the heater by inducing an extermination position of a bubble when the bubble generated by the heater shrinks and dissipates.

27 Claims, 13 Drawing Sheets

THERMAL INKJET PRINTHEAD APPARATUS TO REGULATE PRESSURE EXERTED BY BUBBLES IN AN INK CHAMBER AND METHOD THEREOF

CROSS-REFERENCE TO RELATED APPLICATIONS

This application claims the benefit of Korean Patent Application No. 10-2005-0052034, filed on Jun. 16, 2005, in the Korean Intellectual Property Office, the entire contents of which are incorporated herein by reference.

BACKGROUND OF THE INVENTION

1. Field of the Invention

The present general inventive concept relates to an inkjet printhead, and more particularly, to a thermal inkjet printhead having a heater with enhanced durability protection from pressure induced by bubble extermination.

2. Description of the Related Art

In general, an inkjet printhead is an apparatus that ejects ink droplets on a desired area of recording paper in order to print predetermined color images. The inkjet printhead is categorized into two types based on the ink droplet ejection mechanism used. The first type of inkjet printhead is a thermal inkjet printhead that ejects ink droplets due to an expansion force of bubbles generated by thermal energy. The second type of inkjet printhead is a piezoelectric inkjet printhead that ejects ink droplets by applying a pressure to the ink caused by the deformation of a piezoelectric body.

The ink droplet ejection mechanism of the thermal inkjet printhead is as follows. When a current flows through a heater made of a heating resistor, the heater heats up and ink near the heater in an ink chamber, is instantaneously heated up to about 300° C. Accordingly, bubbles are generated by ink evaporation, and the generated bubbles are expanded to exert a pressure on the ink filled in the ink chamber. As a result, an ink droplet is ejected through a nozzle out of the ink chamber.

Regarding the relationship between the direction of growing an ink bubble and the direction of ejecting an ink droplet, the thermal inkjet printhead is classified into a top-shooting type, a side-shooting type, and a back-shooting type. In the top-shooting type, the growing direction of an ink bubble and the ejecting direction of an ink droplet are the same. In the side-shooting type, the growing direction of an ink bubble is perpendicular to the ejecting direction of an ink droplet. In the back-shooting type, the growing direction of an ink bubble is opposite to the ejecting direction of an ink droplet.

FIG. 1 is a schematic cross-sectional view of a conventional thermal inkjet printhead. Referring to FIG. 1, the conventional inkjet printhead has a substrate 11 on which a plurality of material layers are stacked. A chamber layer 20 is stacked on the substrate 11 and the plurality of material layers, and a nozzle plate 30 is stacked on the chamber layer 20, which defines the ink chamber 22. Ink is filled in the ink chamber 22 and a heater 13 heating the ink to generate bubbles is installed under the ink chamber 22. In addition, the nozzle plate 30 has a nozzle, which is used to eject the ink.

Also included in FIG. 1 is an insulation layer 12 formed on the substrate 11 for heat and electric insulation between the heater 13 and the substrate 11. The heater 13 used to heat the ink in the ink chamber 22 to generate bubbles is disposed on the insulation layer 12. The heater 13 is formed by depositing a thin film on the insulation layer 12, for example, tantalum nitride (TaN) or tantalum-aluminum alloy (TaAl). Conductors 14 supplying an electric current to the heater 13 are disposed on the heater 13. The conductors 14 may be made of a metal having high electric conductivity, such as aluminum (Al).

A passivation layer 15 is formed on the heater 13 and the conductors 14 to protect them. The passivation layer 15 prevents the heater 13 and the conductors 14 from oxidizing or directly contacting the ink, and is formed by depositing a protective film, for example, a silicon nitride ($SiN_x$) film. An anti-cavitation layer 16 is formed on the passivation layer 15 to protect the heater 13 from cavitation pressure induced by bubble extermination, and is made of mainly a protective material, such as tantalum (Ta).

However, in the above-described thermal inkjet printhead, when a bubble dissipates, the induced cavitation pressure is concentrated at a certain point of the upper surface of the anti-cavitation layer 16 formed on the heater 13. The pressure may cause damage to the anti-cavitation layer 16 and the surface of the heater 13 because of a weak pressure resistance of the passivation layer 15 used to protect the heater 13. Such damage to the heater 13 decreases the lifetime of the inkjet printhead.

SUMMARY OF THE INVENTION

The present general inventive concept provides a thermal inkjet printhead, having a heater with enhanced durability to protect a surface of the heater from pressure induced by bubble extermination and a method thereof.

Additional aspects and/or utilities of the present general inventive concept will be set forth in part in the description which follows and, in part, will be obvious from the description, or may be learned by practice of the general inventive concept.

The foregoing and/or other aspects and utilities of the present general inventive concept provide a thermal inkjet printhead including a heater to heat ink in an ink chamber to generate bubbles, conductors to supply an electric current to the heater, and a bubble separation wall protuberantly formed on the heater which protects the heater by inducing an extermination position of the bubble when the bubble generated by the heater shrinks and disappears.

The bubble may shrink and disappear against the bubble separation wall.

The bubble separation wall may be protuberantly formed on the heater toward the ink chamber. A longitudinal direction of the bubble separation wall may be parallel or perpendicular to a direction of an electric current flow in the heater. In addition, a passivation layer may be formed on the surface of the heater.

The bubble separation wall may be made of a polymer, such as an epoxy or made of an inorganic material, such as $SiO_2$, $SiN_x$.

When the heater is approximately 22 μm by 55 μm wide, the bubble separation wall may be approximately 4 μm or less in height and approximately 3 μm or less in width.

The foregoing and/or other aspects and utilities of the present general inventive concept may provide a thermal inkjet printhead including a plurality of heaters to heat ink in an ink chamber to generate bubbles, conductors to supply an electric current to the heaters, and at least one bubble separation wall which is protuberantly formed between the heaters and which protects the heaters by inducing an extermination position of the bubble when the bubble generated by the heaters shrinks and disappears.

The bubble separation wall may be protuberantly formed toward the ink chamber between the heaters.

The foregoing and/or other aspects and utilities of the present general inventive concept may provide a printhead apparatus with an ink chamber including a heater to heat ink in the ink chamber and cause at least one bubble to be formed, a bubble separation member protuberantly arranged inside the ink chamber to regulate growth and extermination behavior of bubbles formed inside the ink chamber, and a conductor to provide an electric current to heat the heater, where the electric current flows in one of a parallel or a perpendicular direction to the length of the bubble separation member.

The foregoing and/or other aspects and utilities of the present general inventive concept may provide a printhead apparatus with an ink chamber including at least two heaters to heat ink in the ink chamber and cause at least one bubble to be formed at a time, a bubble separation member protuberantly arranged inside the ink chamber to regulate growth and extermination behavior of the bubbles formed inside the ink chamber, and at least one conductor to provide an electric current to heat the at two heaters.

The foregoing and/or other aspects and utilities of the present general inventive concept may provide a method of regulating bubble growth inside an ink chamber of a printhead including providing an electric charge to a conductor, heating a heater in contact with the conductor via the electric charge, forming at least one bubble inside the ink chamber by allowing heat from the heater to create the at least one bubble, and limiting a growth and extermination area of the at least one bubble by a protuberantly formed separation member inside the ink chamber.

The foregoing and/or other aspects and utilities of the present general inventive concept may provide an inkjet printhead apparatus including an ink chamber to contain ink therein, a heater member to heat the ink to form bubbles, which cause the ink to eject from the ink chamber, and a cavitation absorption member dispersed within the ink chamber to absorb cavitation pressure as the bubbles shrink and disappear.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
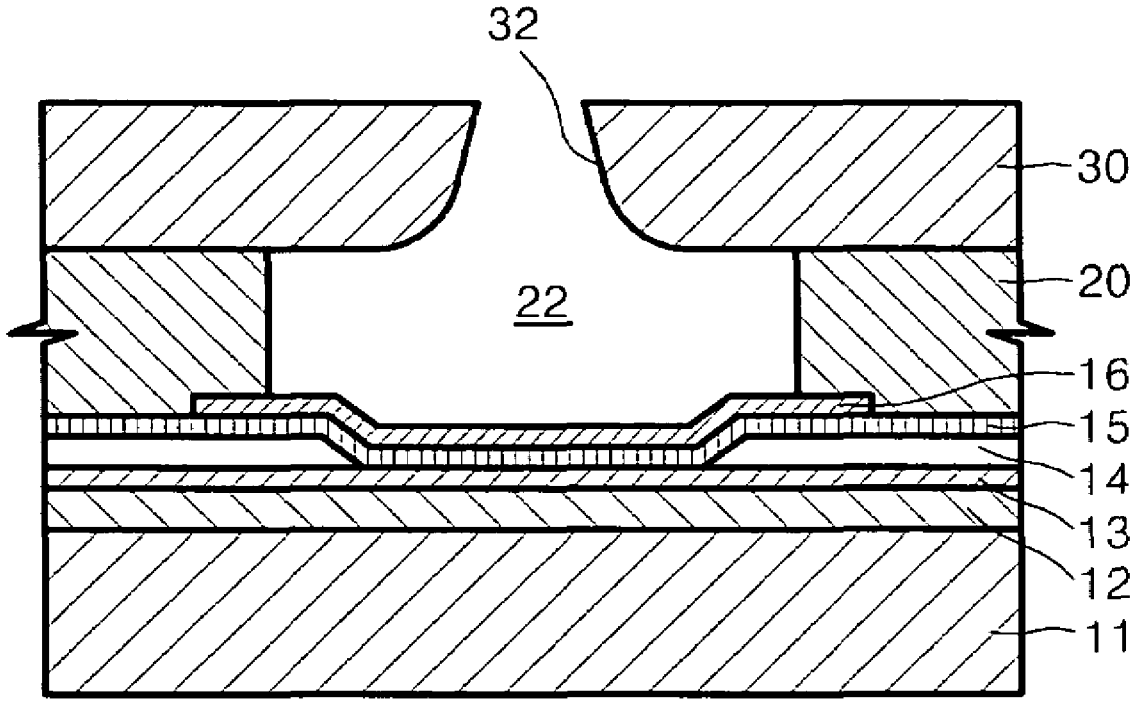
FIG. 1 (RELATED ART)
FIG. 1 is a schematic cross-sectional view of a conventional thermal inkjet printhead.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2A:
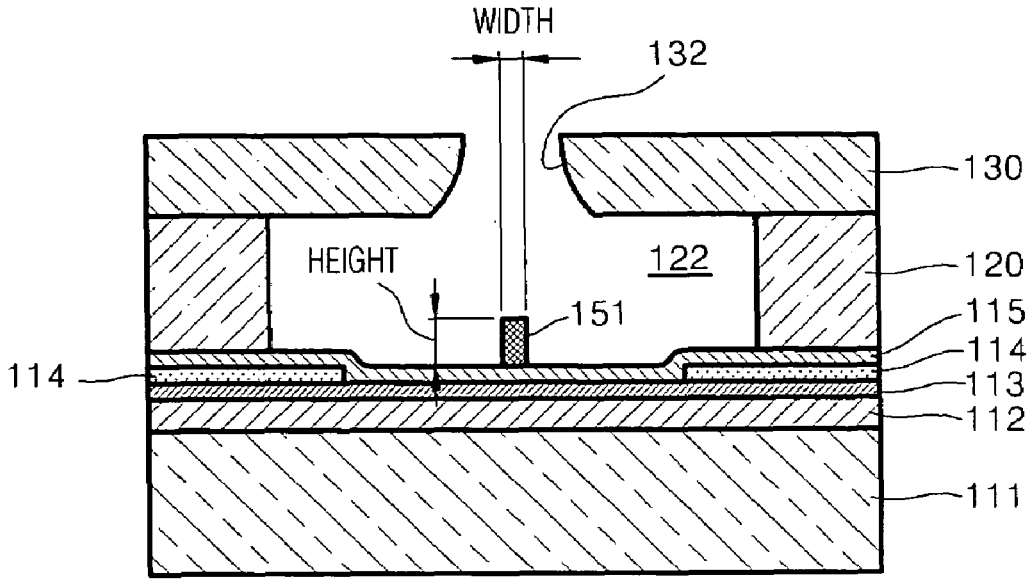
FIG. 2A is a schematic cross-sectional view of a thermal inkjet printhead according to an embodiment of the present general inventive concept.
Figure 2B:
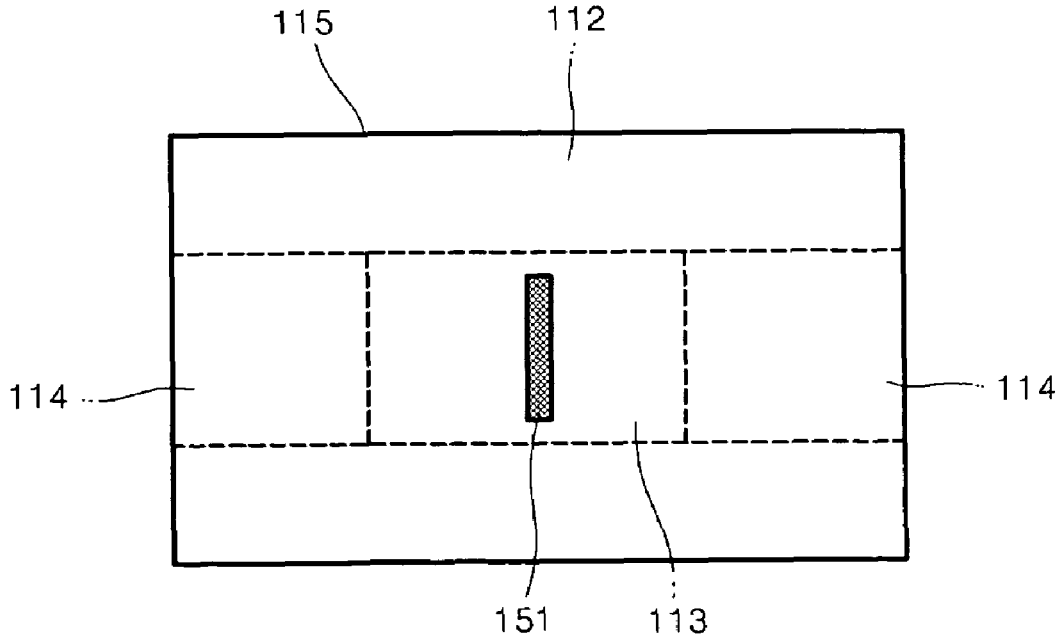
FIG. 2B is a view illustrating a bubble separation wall arranged on the heater of FIG. 2A.

FIG. 2A is a schematic cross-sectional view of a thermal inkjet printhead according to an embodiment of the present general inventive concept. FIG. 2B illustrates a bubble separation wall 151 arranged on the heater 113 of FIG. 2A.

Referring to FIGS. 2A and 2B, the thermal inkjet printhead includes a substrate 111 on which a plurality of material layers are disposed. The layers include a heater 113, conductors 114, a chamber layer 120, and a nozzle plate 130 stacked on the chamber layer 120. The chamber layer 120 defines an ink chamber 122 where ink is filled. The nozzle plate 130 is perforated to form a nozzle 132 used to eject ink which is in the ink chamber 122.

A silicon substrate may be used as the substrate 111. An insulation layer 112 for heat and electric insulation between the heater 113 and the substrate 111 is formed on the upper surface of the substrate 111. The insulation layer 112 is made of, for example, silicon oxide ($SiO_2$) or silicon nitride ($SiN_x$). The heater 113 used to heat the ink and generate bubbles in the ink chamber 122 is disposed on the insulation layer 112. The heater 113 may be formed by depositing tantalum nitride (TaN) (a tantalum-aluminum (TaAl) alloy) as a thin film on the insulation layer 112. Conductors 114 supplying an electric current to the heater are both disposed on an upper surface of the heater 113. The conductors 114 may be made of a metal having high electric conductivity, such as aluminum (Al). In addition, a passivation layer 115 is formed on the heater 113 and the conductors 114 to protect them. The passivation layer 115 may provide protection to the heater 113 and the conductors 114 from oxidization or direct contact with the ink in the ink chamber 122, and may be made of, for example, silicon oxide ($SiO_2$) or silicon nitride $SiN_x$).

A bubble separation wall 151 is formed on the upper surface of the passivation layer 115 which covers the heater 113. The bubble separation wall 151 may provide protection to the heater 113 from a cavitation pressure generated by the extermination of a bubble. Here, the bubble separation wall 151 is protuberantly formed toward the area of the ink chamber 122. It is to be noted that the general inventive concept is not limited to a wall, but may be provided as another type of shape or member which serves the intended purpose as provided herein. The longitudinal direction of the bubble separation wall 151 is perpendicular to the direction of an electric current flow through the heater 113 via the conductors 114. The bubble separation wall 151 may be made of a polymer, for example, an epoxy or an inorganic material, such as $SiO_2$, $SiN_x$. The bubble separation wall 151 separates the bubble generated by the heater 113, thereby changing the growth and extermination behavior of the bubble, compared to the case where there is no bubble separation wall 151. Accordingly, when a bubble generated by the heater 113 shrinks and disappears, the bubble can disappear while not on the surface of the heater 113 but instead against the bubble separation wall 151 due to the presence of the bubble separation wall 151 in the ink chamber 122. Therefore, when a bubble generated by the heater 113 shrinks and disappears, the bubble separation wall 151 can force the bubble to disappear on a position other than the heater 113, thus protecting the heater 113 from a cavitation pressure generated by bubble extermination.

The size of the bubble separation wall 151 can vary corresponding to the size of the installed heater 113. For example, in the thermal inkjet printhead according to an example embodiment of the present general inventive concept, when a heater of 22 μm by 55 μm is used, the bubble separation wall 151 may be 4 μm or less in height and 3 μm or less in width based on computer simulation analysis results, which will be described in more detail later. The bubble separation wall 151 reduces the total heating area of the heater 113, which may decrease the capability of ink ejection, however, the corresponding affect this may have on the printing performance of an inkjet printhead is insignificant.

Figure 3A:
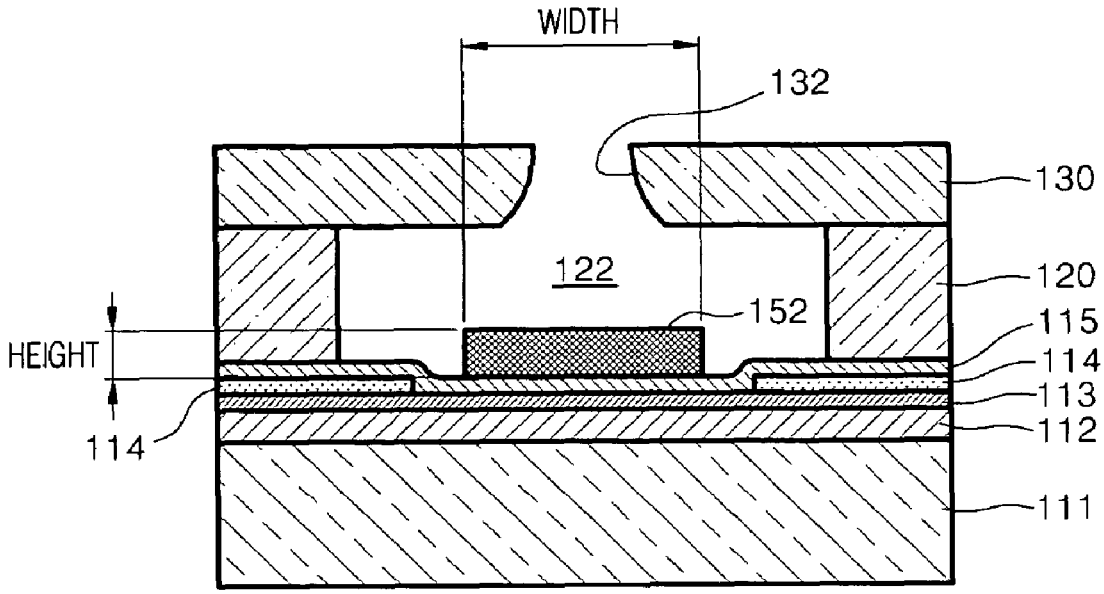
FIG. 3A is a schematic cross-sectional view of a thermal inkjet printhead according to another embodiment of the present general inventive concept.
Figure 3B:
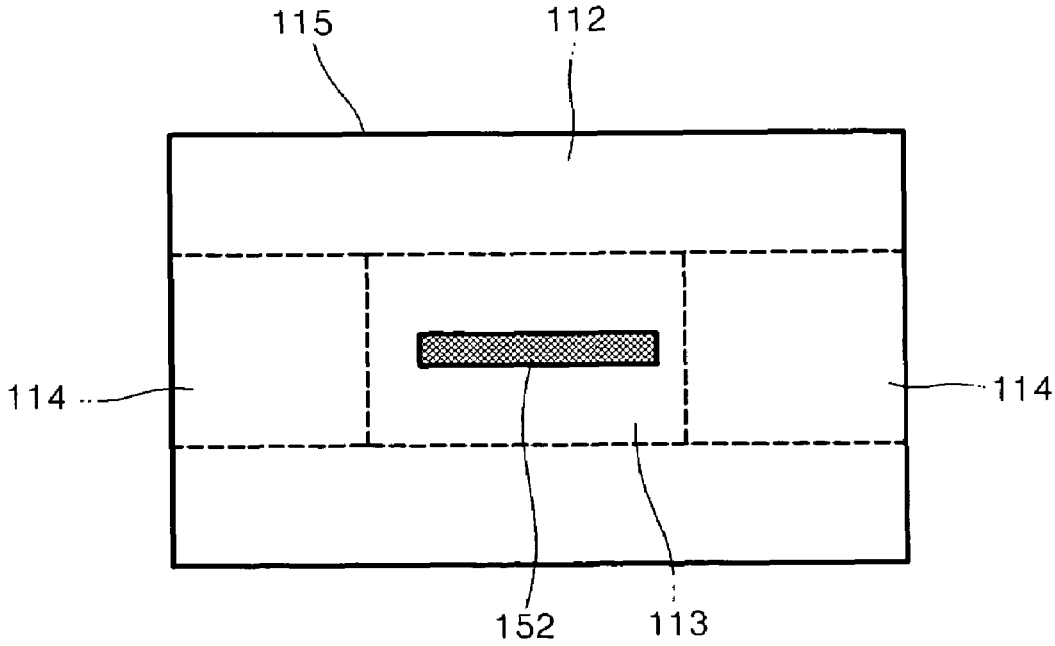
FIG. 3B is a view illustrating a bubble separation wall arranged on the heater of FIG. 3A

FIG. 3A is a schematic cross-sectional view of a thermal inkjet printhead according to another embodiment of the present general inventive concept. FIG. 3B illustrates a bubble separation wall 152 arranged on the heater 113 of FIG. 3A.

Referring to FIGS. 3A and 3B, the longitudinal direction of the bubble separation wall 152 is arranged parallel to the direction of an electric current flow in the heater 113 via conductors 114. When a bubble generated by the heater 113 shrinks and disappears, the bubble separation wall 152 allows the bubble to disappear at a position other than the heater 113 to protect the heater 113 from the cavitation pressure.

Figure 4A:
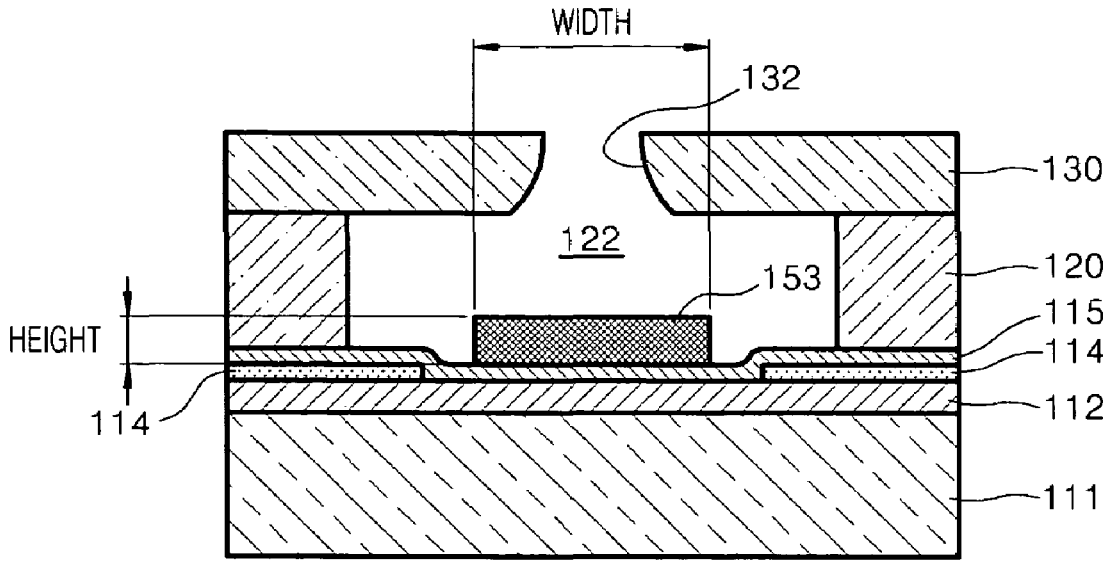
FIG. 4A is a schematic cross-sectional view of a thermal inkjet printhead according to still another embodiment of the present general inventive concept.
Figure 4B:
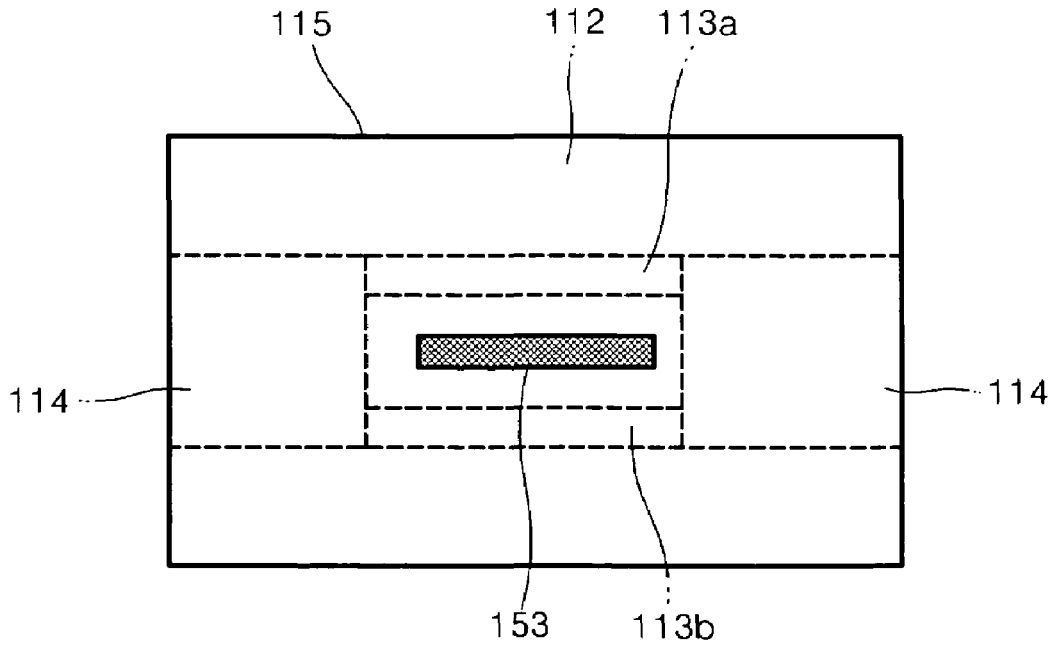
FIG. 4B is a view illustrating a bubble separation wall arranged between the heaters of FIG. 4A.
Figure 5A:
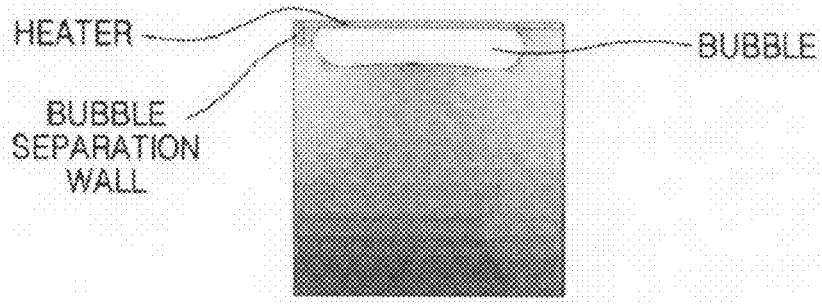
FIGS. 5A through 5D show computer simulation analysis results of a bubble growth and extermination in the case of a bubble separation wall of 2.0 μm in width and 2.0 μm in height.
Figure 5B:
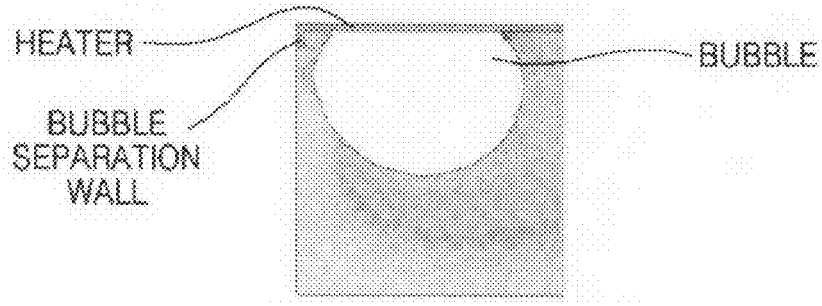
Figure 5C:
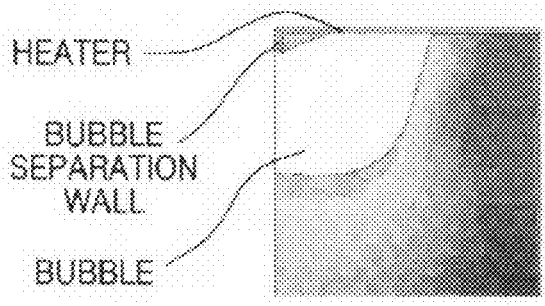
Figure 5D:
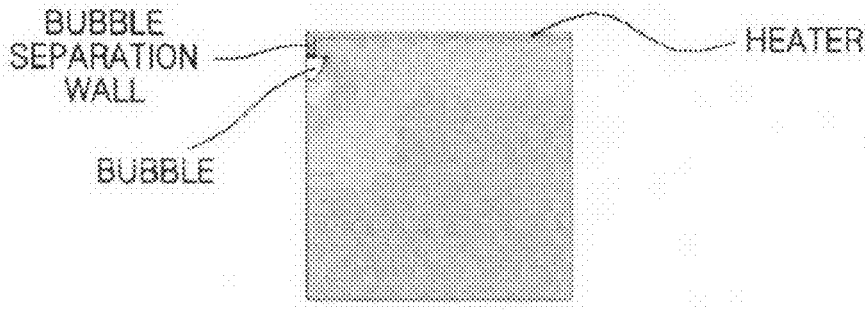
Figure 6A:
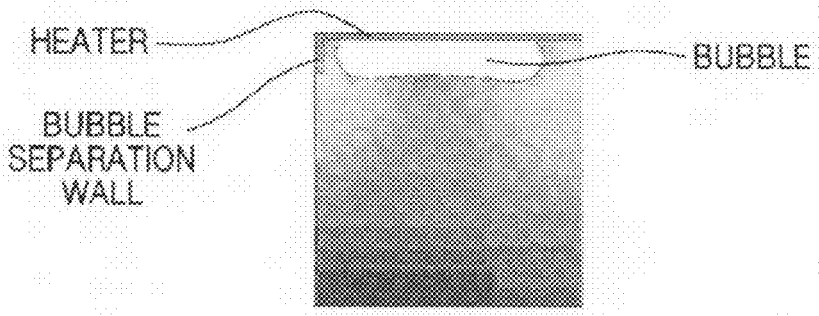
FIGS. 6A through 6D show computer simulation analysis results of a bubble growth and extermination in the case of a bubble separation wall of 2.0 μm in width and 4.0 μm in height.
Figure 6B:
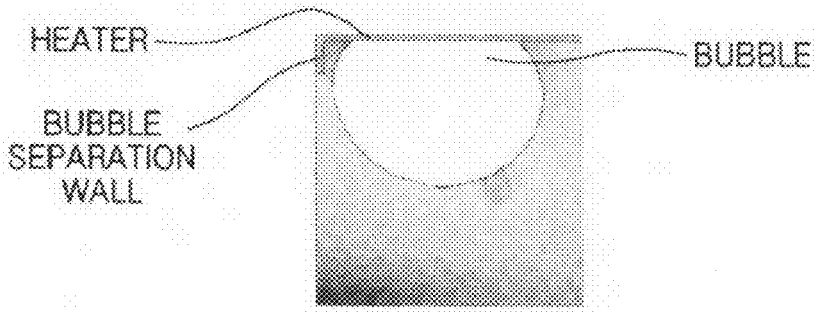
Figure 6C:
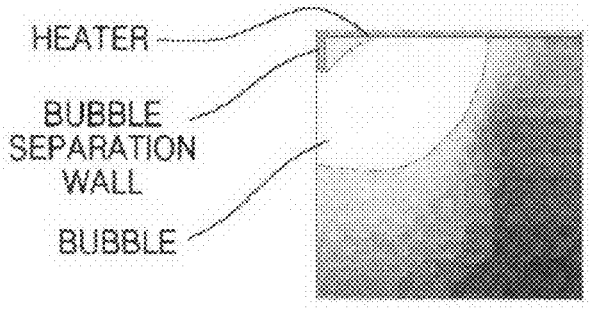
Figure 6D:
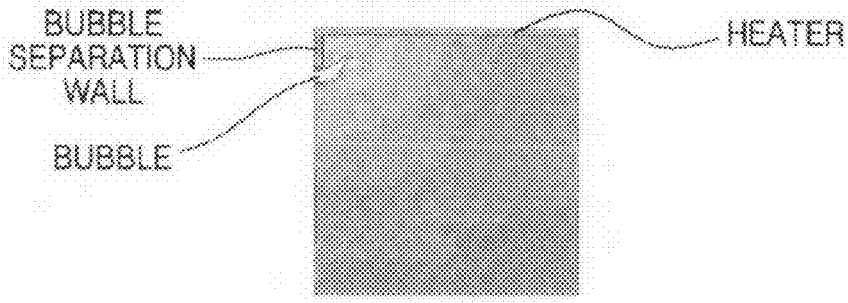
Figure 7A:
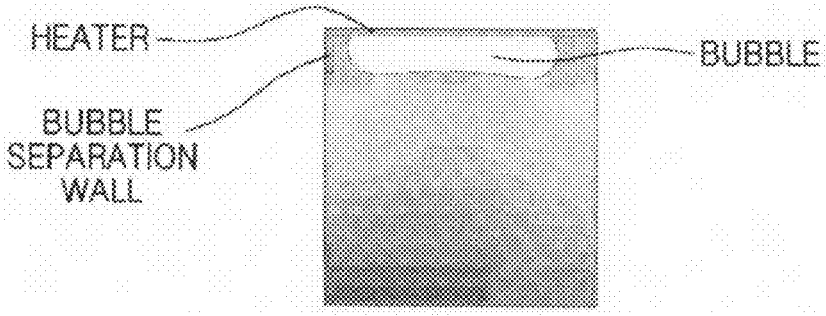
FIGS. 7A through 7D show computer simulation analysis results of a bubble growth and extermination in the case of a bubble separation wall of 2.0 μm in width and 4.5 μm in height.
Figure 7B:
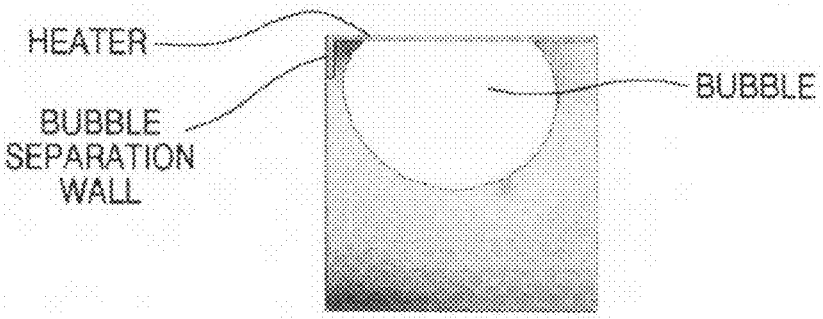
Figure 7C:
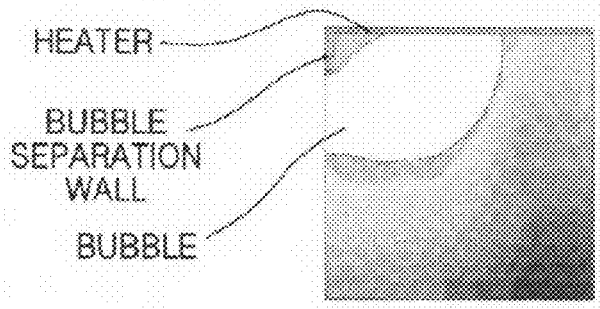
Figure 7D:
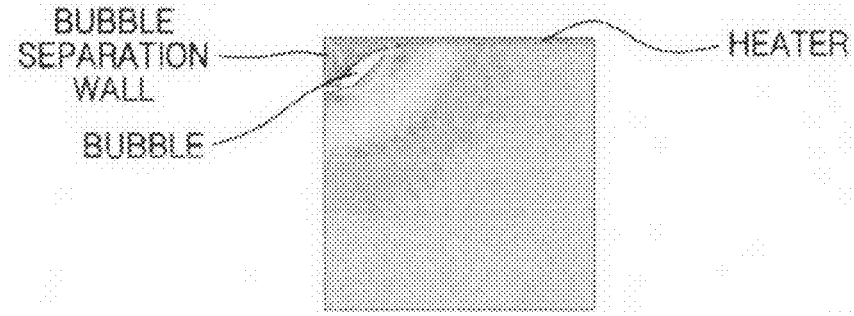
Figure 8A:
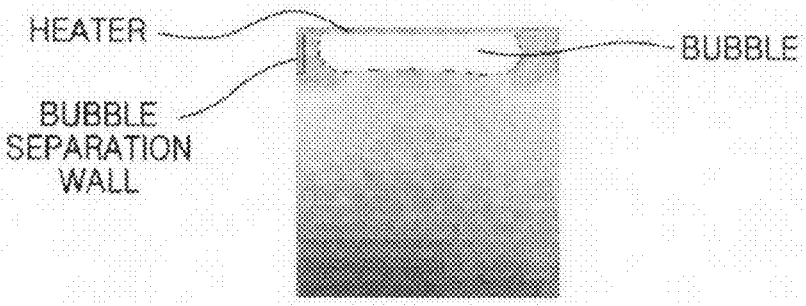
FIGS. 8A through 8D show computer simulation analysis results of a bubble growth and extermination in the case of a bubble separation wall of 2.0 μm in width and 5.0 μm in height.
Figure 8B:
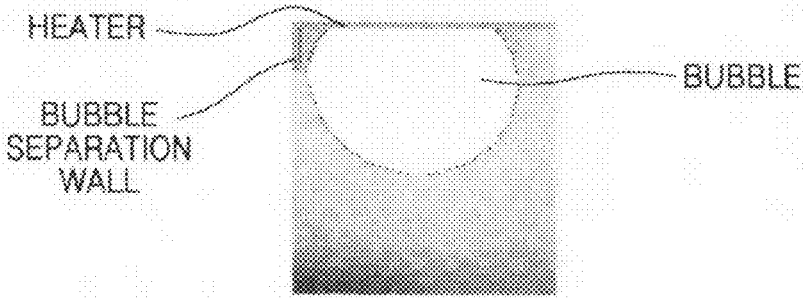
Figure 8C:
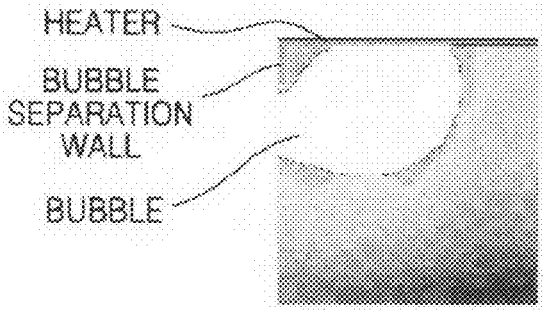
Figure 8D:
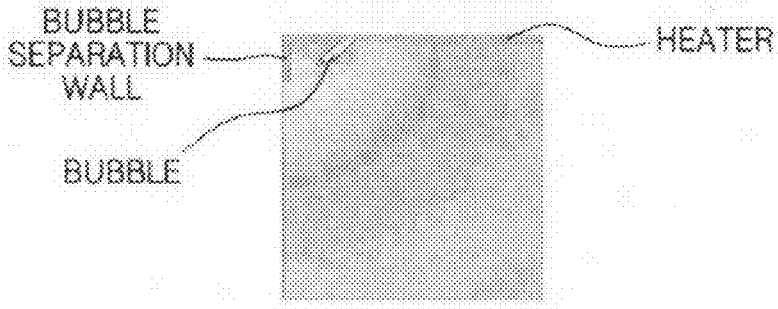
Figure 9A:
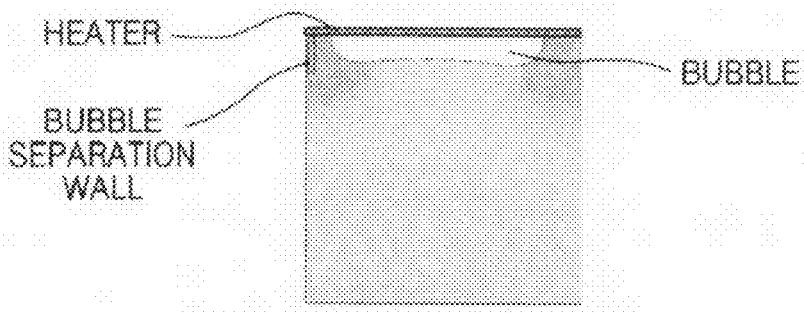
FIGS. 9A through 9D show computer simulation analysis results of a bubble growth and extermination in the case of a bubble separation wall of 2.0 μm in width and 6.0 μm in height.
Figure 9B:
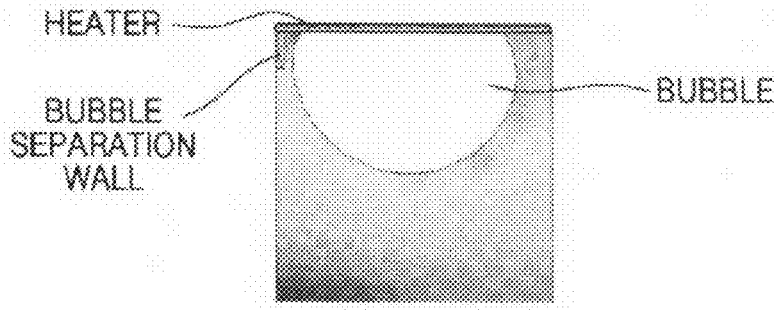
Figure 9C:
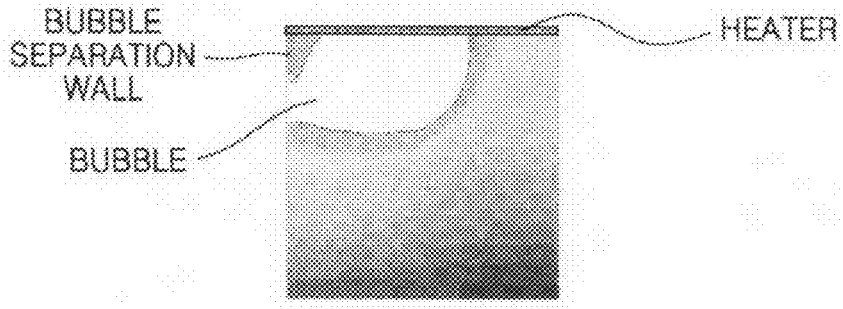
Figure 9D:
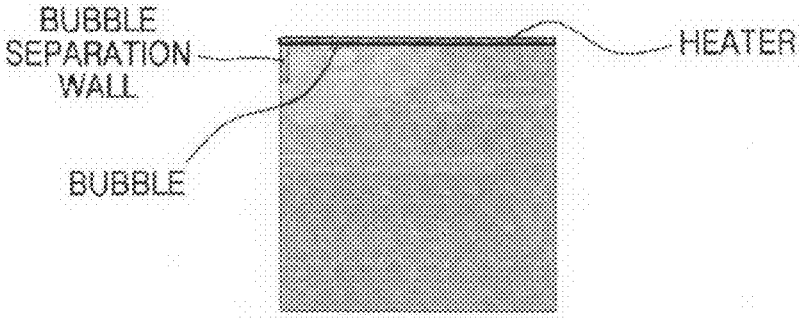
Figure 10A:
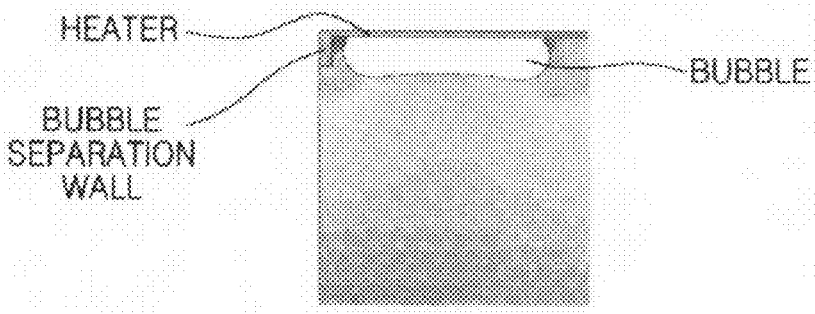
FIGS. 10A through 10D show computer simulation analysis results of a bubble growth and extermination in the case of a bubble separation wall of 3.0 μm in width and 3.5 μm in height.
Figure 10B:
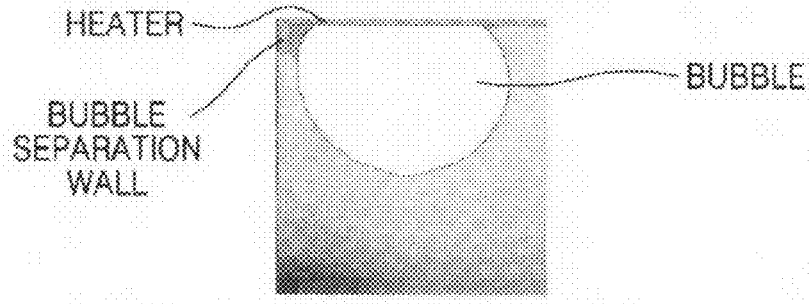
Figure 10C:
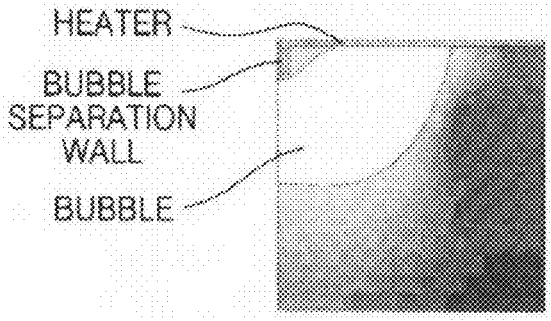
Figure 10D:
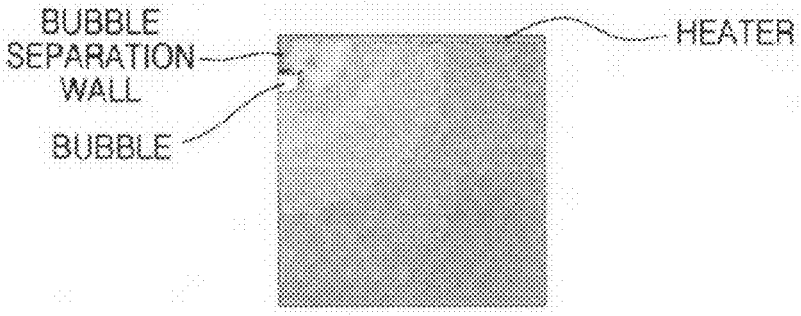
Figure 11A:
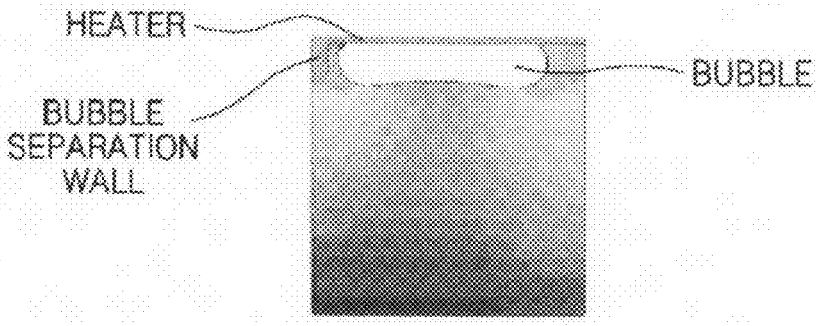
FIGS. 11A through 11D show computer simulation analysis results of a bubble growth and extermination in the case of a bubble separation wall of 4.0 μm in width and 3.5 μm in height.
Figure 11B:
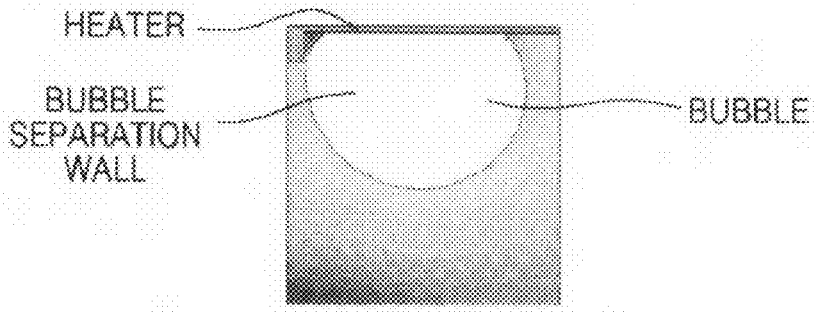
Figure 11C:
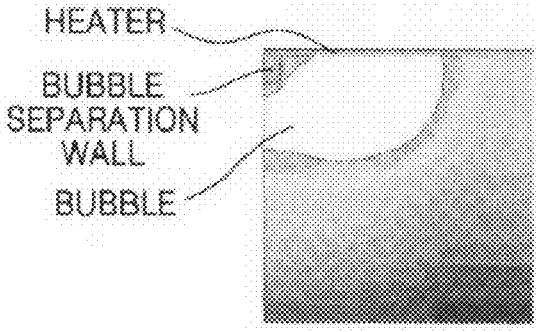
Figure 11D:
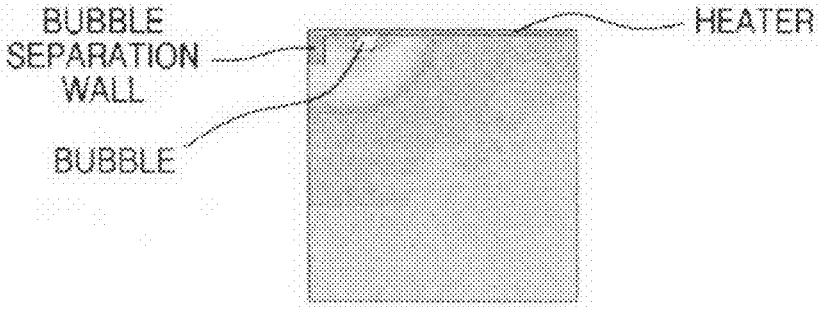
Figure 12A:
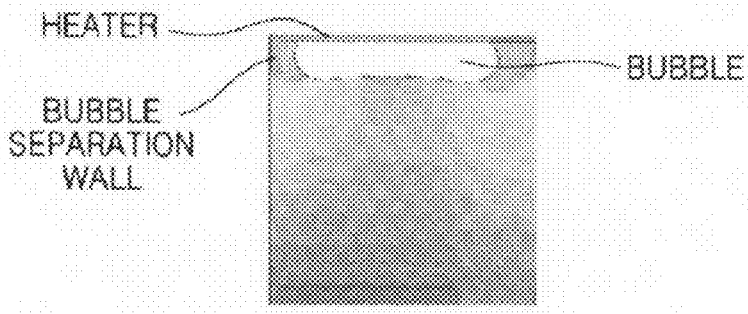
FIGS. 12A through 12D show computer simulation analysis results of a bubble growth and extermination in the case of a bubble separation wall of 3.0 μm in width and 4.0 μm in height.
Figure 12B:
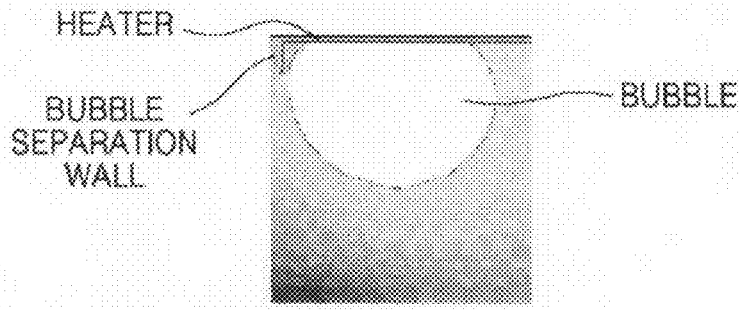
Figure 12C:
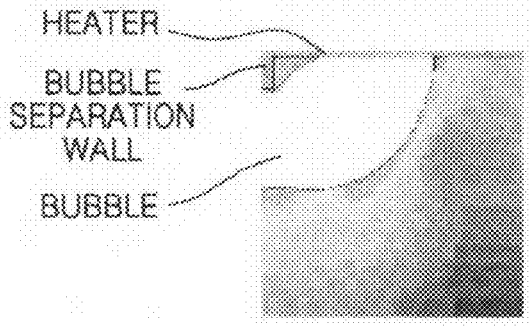
Figure 12D:
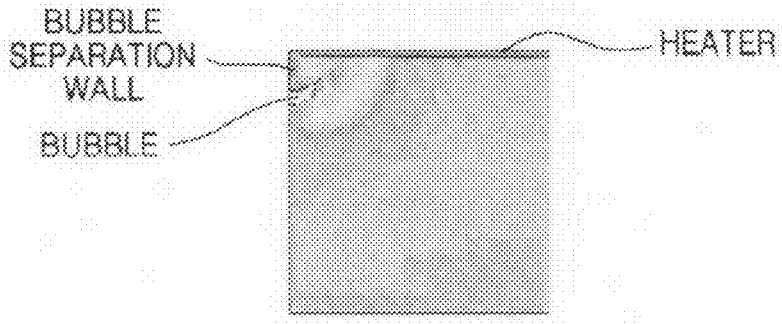
Figure 13A:
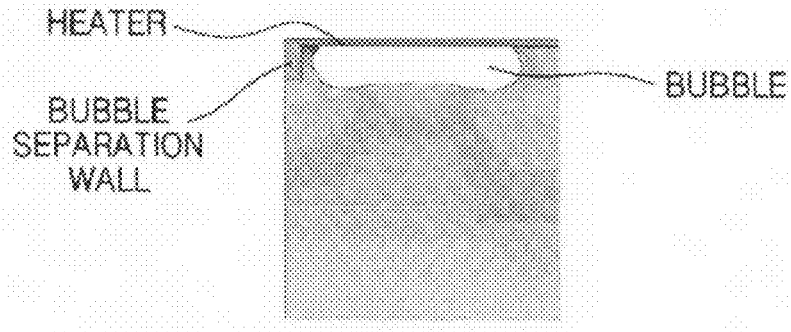
FIGS. 13A through 13D show computer simulation analysis results of a bubble growth and extermination in the case of a bubble separation wall of 4.0 μm in width and 4.0 μm in height.
Figure 13B:
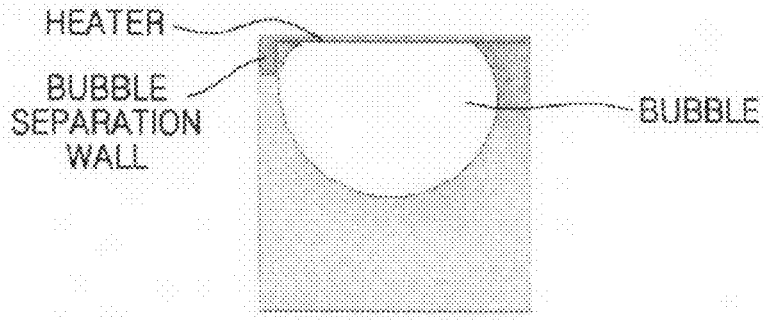
Figure 13C:
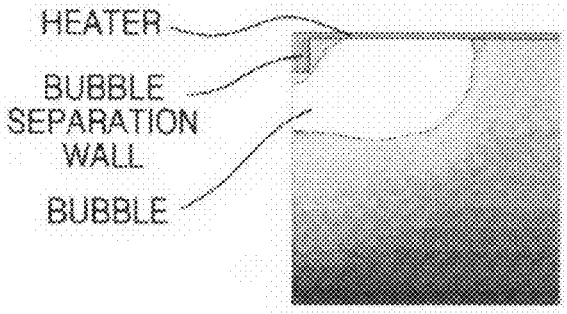
Figure 13D:
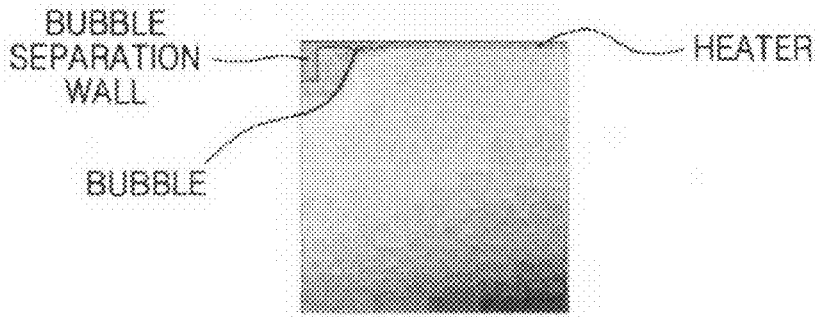

FIG. 4A is a schematic cross-sectional view of a thermal inkjet printhead according to still another embodiment of the present general inventive concept. FIG. 4B illustrates a bubble separation wall 153 arranged between first and second heaters 113*a* and 113*b* of FIG. 4A.

Referring to FIGS. 4A and 4B, the first and second heaters 113*a* and 113*b* used to heat ink and generate bubbles in an ink chamber 122, are disposed on the upper surface of an insulation layer 112, which in turn is formed on a substrate 111. In addition, conductors 114, which supply an electric current to the first and second heaters 113*a* and 113*b* are disposed on both upper surfaces of the first and second heaters 113*a* and 113*b*. In addition, passivation layer 115 is formed on the first and second heaters 113*a* and 113*b* and the conductors 114 to protect them.

The bubble separation wall 153 is formed on the upper surface of the passivation layer 115 between the first and second heaters 113*a* and 113*b*. The bubble separation wall 153 protects the heater 113 from cavitation pressure generated by extermination of a bubble formed by uniting bubbles individually generated by the first and second heaters 113*a* and 113*b*. The bubble separation wall 153 is protuberantly formed toward the ink chamber 122. The bubble separation wall 153 may be made of a polymer, such as an epoxy or an inorganic material, for example, $SiO_2$ or $SiN_x$. The bubble separation wall 153 separates the bubbles generated by the first and second heaters 113*a* and 113*b*, which changes the growth and extermination behavior of the bubble as compared to the case of no bubble separation wall 153. Accordingly, when a bubble formed by uniting bubbles individually generated by the first and second heaters 113*a* and 113*b* shrinks and disappears, the bubble can disappear while not on the surface of the first and second heaters 113*a* and 113*b* but, instead against the bubble separation wall 153. The bubble can disappear at a position other than the first and second heaters 113*a* and 113*b* and the bubble separation wall 153.

The above-described embodiments have been described with reference to a top-shooting typed inkjet printhead in which the growing direction of an ink bubble and the ejecting direction of an ink droplet are the same. However, the present general inventive concept can also be applied to a side-shooting type inkjet printhead in which the growing direction of an ink bubble is perpendicular to the growing direction of an ink droplet, and a back-shooting typed inkjet printhead in which the growing direction of an ink bubble is opposite to the ejecting direction of an ink droplet. In these cases, when a bubble shrinks and disappears, the bubble separation wall for to induce an extermination position of a bubble is protuberantly formed toward the ink chamber 122, and the size of the bubble separation wall can be varied according to the shape and size of the heater.

Hereinafter, in the thermal inkjet printhead embodiments of the present general inventive concept, an extermination position of a bubble corresponding to the size of a bubble separation wall can be analyzed by using computer simulations. The dimensions of the heater in the following simulations have been uniformly set to 22 μm by 55 μm.

FIGS. 5A through 5D show computer simulation analysis results of bubble growth and extermination in the case of a bubble separation wall of 2.0 μm in width and 2.0 μm in height. FIGS. 6A through 6D show computer simulation analysis results of bubble growth and extermination in the case of a bubble separation wall of 2.0 μm in width and 4.0 μm in height. Referring to FIGS. 5A through 5D, the bubble separation wall was approximately 2.0 μm in height, and although the bubble shrinks and disappears on the separation wall, it is important to consider other dimensions of the bubble separation wall before determining an appropriate size. Referring to FIGS. 6A through 6D, when the height of the bubble separation wall was approximately 4.0 μm, the bubble generated by the heater shrank and disappeared on the bubble separation wall. In this case, the heater can be protected from cavitation pressure induced by the bubble extermination.

FIGS. 7A through 7D show computer simulation analysis results of a bubble growth and extermination in the case of a bubble separation wall of 2.0 μm in width and 4.5 μm in height. Referring to FIGS. 7A through 7D, the bubble generated by the heater shrank and disappeared on the surface of the heater as well as at the bubble separation wall. In this case, the surface of the heater is possibly damaged by a cavitation pressure induced by the bubble extermination.

FIGS. 8A through 8D show computer simulation analysis results of a bubble growth and extermination in the case of a bubble separation wall of 2.0 μm in width and 5.0 μm in height. FIGS. 9A through 9D show computer simulation analysis results of a bubble growth and extermination in the case of a bubble separation wall of 2.0 μm in width and 6.0 μm in height. Referring to FIGS. 8A through 8D and 9A through 9D, when the height of the bubble separation wall was approximately 5.0 μm or more, the bubble generated by the heater shrank and disappeared on the surface of the heater. In this case, the surface of the heater is possibly damaged by a cavitation pressure induced by the bubble extermination.

FIGS. 10A through 10D show computer simulation analysis results of a bubble growth and extermination in the case of a bubble separation wall of 3.0 μm in width and 3.5 μm in height. FIGS. 11A through 11D show computer simulation analysis results of a bubble growth and extermination in the case of a bubble separation wall of 4.0 μm in width and 3.5 μm in height. Referring to FIGS. 10A through 10D and 11A through 11D, the bubble shrank and disappeared on the bubble separation wall when the width of the bubble separation wall was 3.0 μm, and the bubble shrank and disappeared on the surface of the heater when the width of the bubble separation wall was 4.0 μm.

FIGS. 12A through 12D show computer simulation analysis results of a bubble growth and extermination in the case of a bubble separation wall of 3.0 μm in width and 4.0 μm in height. FIGS. 13A through 13D show computer simulation analysis results of a bubble growth and extermination in the case of a bubble separation wall of 4.0 μm in width and 4.0 μm in height. Referring to FIGS. 12A through 12D and 13A through 13D, the bubble shrink and disappeared on the bubble separation wall when the width of the bubble separation wall was 3.0 μm, and the bubble vanished on the surface of the heater when the width of the bubble separation wall was 4.0 μm.

Consequently, when a heater of 22 μm by 55 μm is used, the bubble separation wall has preferably a height of about 4.0 μm or less and a width of 3.0 μm or less to make the bubble shrink and disappear at the bubble separation wall and not on the heater.

The thermal inkjet printhead according to the present general inventive concept has a bubble separation wall for inducing a bubble extermination position such that a bubble generated by a heater can shrink and disappear on the separation wall, not on the surface of the heater. Accordingly, the damage to the surface of the heater caused by a cavitation pressure due to bubble extermination can be reduced, which increases the durability of the heater and the lifetime of the inkjet printhead.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A thermal inkjet printhead comprising:

a heater to heat ink in an ink chamber to generate bubbles;

conductors to supply an electric current to the heater; and a bubble separation wall protuberantly formed on a passivation layer which is disposed on the heater, and which protects the heater by inducing an extermination position of the bubble when the bubble generated by the heater shrinks and disappears.

2. The thermal inkjet printhead of claim 1, wherein the bubble shrinks and disappears on the bubble separation wall.

3. The thermal inkjet printhead of claim 1, wherein the bubble separation wall is protuberantly formed on the heater toward the ink chamber.

4. The thermal inkjet printhead of claim 3, wherein the longitudinal direction of the bubble separation wall is parallel to a direction of an electric current flow in the heater.

5. The thermal inkjet printhead of claim 3, wherein the longitudinal direction of the bubble separation wall is perpendicular to a direction of an electric current flow in the heater.

6. The thermal inkjet printhead of claim 1, wherein the bubble separation wall is made of a polymer or an inorganic material.

7. The thermal inkjet printhead of claim 6, wherein the polymer comprises an epoxy.

8. The thermal inkjet printhead of claim 6, wherein the inorganic material comprises $SiO_2$ and $SiN_x$.

9. The thermal inkjet printhead of claim 8, wherein a width of the bubble separation wall is approximately 3 μm or less.

10. A thermal inkjet printhead comprising:

a heater to heat ink in an ink chamber to generate bubbles;

conductors to supply an electric current to the heater; and a bubble separation wall protuberantly formed on the heater, and which protects the heater by inducing an extermination position of the bubble when the bubble generated by the heater shrinks and disappears, wherein the heater is approximately 22μm by 55μm wide.

11. The thermal inkjet printhead of claim 10, wherein a height of the bubble separation wall is approximately 4μm or less.

12. A thermal inkjet printhead comprising:

a plurality of heaters to heat ink in an ink chamber to generate bubbles;

conductors to supply an electric current to the heaters; and at least one bubble separation wall protuberantly formed between the heaters and which protects the heaters by inducing an extermination position of the bubble when the bubble generated by the heaters shrinks and disappears.

13. The thermal inkjet printhead of claim 12, wherein the bubble shrinks and disappears against the bubble separation wall.

14. The thermal inkjet printhead of claim 12, wherein the bubble separation wall is protuberantly formed toward the ink chamber between the heaters.

15. The thermal inkjet printhead of claim 12, further comprising: a passivation layer is formed on the surface of the heater.

16. The thermal inkjet printhead of claim 12, wherein the bubble separation wall is made of a polymer or an inorganic material.

17. the thermal inkjet printhead of claim 16, wherein the polymer comprises an epoxy.

18. The thermal inkjet printhead of claim 16, wherein the inorganic material comprises $SiO_2$ and $SiN_X$.

19. A printhead apparatus including an ink chamber, the apparatus comprising:

a heater to heat ink in the ink chamber and cause at least one bubble to be formed;

a bubble separation member protuberantly arranged inside the ink chamber to regulate growth and extermination behavior of bubbles formed inside the ink chamber; and a conductor to provide an electric current to heat the heater, where the electric current flows in one of a parallel or a perpendicular direction to the length of the bubble separation member, wherein the bubble separation member is disposed on a passivation layer which is disposed on the heater.

20. The apparatus of claim 19, wherein the growth and extermination behavior of the bubbles formed inside the ink chamber are regulated by inhibiting the growth and extermination area of the bubbles such that the bubbles grow and diminish away from a location of the heater.

21. The apparatus of claim 19, wherein the electric current flows in a direction parallel to the length of the bubble separation member.

22. The apparatus of claim 19, wherein the electric current flows in a direction perpendicular to the length of the bubble separation member.

23. A printhead apparatus including an ink chamber, the apparatus comprising:

at least two heaters to heat ink in the ink chamber and cause at least one bubble to be formed at a time;

a bubble separation member protuberantly arranged inside the ink chamber between the at least two heaters to regulate growth and extermination behavior of the bubbles formed inside the ink chamber; and at least one conductor to provide an electric current to heat the at least two heaters.

24. The apparatus of claim 23, wherein the growth and extermination behavior of the at least one bubble formed inside the ink chamber is regulated by inhibiting the growth and extermination area of the at least one bubble such that the at least one bubble grows and dissipates away from a location of the heater.

25. The apparatus of claim 23, wherein the electric current flows in a direction parallel to the length of the bubble separation member.

26. The apparatus of claim 23, wherein the electric current flows in a direction perpendicular to the length of the bubble separation member.

27. The apparatus of claim 23, further comprising:

a passivation layer disposed between the bubble separation member and the heater.

* * * * *